US005836089A

United States Patent [19]

Lipsker

[11] Patent Number: 5,836,089

[45] Date of Patent: Nov. 17, 1998

[54] EXCAVATING EQUIPMENT FITTED WITH SURFACE CLAMPS

[76] Inventor: Yitshaq Lipsker, 24 Trumpeldor St., Ramat Hasharon 47264, Israel

[21] Appl. No.: 728,940

[22] Filed: Oct. 11, 1996

Related U.S. Application Data

[63] Continuation-in-part of Ser. No. 507,259, filed as PCT/US94/01777, Feb. 22, 1994 published as WO94/19272, Sep. 1, 1994, abandoned.

[30] Foreign Application Priority Data

Feb. 22, 1993 [IL] Israel ..... 104820

[51] Int. Cl.[6] ..... B66C 3/02

[52] U.S. Cl. ..... 37/186; 37/188; 175/99; 299/11

[58] Field of Search ..... 37/461, 184, 185, 37/186, 187, 188; 175/57, 94, 99, 171; 299/11, 31; 405/146, 150; 166/286, 287

[56] References Cited

U.S. PATENT DOCUMENTS

| | | | |
|---|---|---|---|
| 2,637,527 | 5/1953 | Andrews, Jr. | 175/99 |
| 3,357,506 | 12/1967 | Bosredon | 175/99 |
| 3,443,648 | 5/1969 | Howard | 175/99 |
| 3,516,183 | 6/1970 | Serota | 37/116 |
| 3,829,992 | 8/1974 | Reid et al. | 37/184 X |
| 3,881,263 | 5/1975 | Coeurderoy | 37/186 |
| 3,965,995 | 6/1976 | Sugden | 175/57 |
| 4,179,001 | 12/1979 | Still et al. | 175/94 X |
| 4,202,416 | 5/1980 | Blaschke et al. | 175/94 |
| 4,312,541 | 1/1982 | Spurgeon | 175/94 X |
| 4,314,615 | 2/1982 | Sodder, Jr. et al. | 175/94 |
| 4,373,278 | 2/1983 | Myrick | 37/71 |
| 4,547,106 | 10/1985 | Lipsker | 405/259 |
| 4,694,915 | 9/1987 | Bauer et al. | 175/91 |
| 4,742,876 | 5/1988 | Barthelemy et al. | 175/94 X |
| 4,744,425 | 5/1988 | Hentschel | 175/94 X |
| 4,761,098 | 8/1988 | Lipsker | 405/262 |
| 4,770,255 | 9/1988 | Barthelemy et al. | 175/94 X |
| 4,770,256 | 9/1988 | Lipsker et al. | 175/57 |
| 4,915,453 | 4/1990 | Fikse | 299/31 |
| 4,957,175 | 9/1990 | Lipsker et al. | 175/94 |
| 5,174,683 | 12/1992 | Grandori | 405/145 |

FOREIGN PATENT DOCUMENTS

| | | |
|---|---|---|
| 0518298 | 12/1992 | European Pat. Off. . |
| 2573475 | 5/1986 | France . |
| 2645559 | 10/1990 | France . |
| 3615068 | 10/1987 | Germany . |
| 4018086 | 5/1992 | Germany . |
| 4108991 | 4/1992 | Japan . |
| 32407 | 8/1979 | Poland . |
| 371312 | 2/1973 | U.S.S.R. . |
| 658231 | 5/1979 | U.S.S.R. . |

*Primary Examiner*—Terry Lee Melius
*Assistant Examiner*—Victor Batson
*Attorney, Agent, or Firm*—Helfgott & Karas, P.C.

[57] ABSTRACT

Excavating equipment comprising a rigid support structure with articulately mounted surface clamps, an excavating device downstream of the surface clamps in a direction of excavation and an urging device for urging the excavation means in a direction of excavation during excavating. The equipment further comprises a power device coupled to the excavating device for operating same and for operating the urging device. The power device is also coupled to the surface clamps for laterally displacing the surface clamps against rigid supporting surfaces so as to generate a counter-reaction to forces generated by operation of the excavating device. Additionally, a displacing device is coupled to the support structure for displacing the equipment into and out of an excavation. Alternatively, when the equipment is used for excavation in rocky sites, the equipment can comprise a first rigid support structure and a second rigid support structure articulated to the first structure, with an expansion device for displacing the second rigid structure with respect to the first structure, and with the equipment further comprising a power device coupled to the rotary milling cutters for operating same.

17 Claims, 14 Drawing Sheets

EXCAVATING EQUIPMENT FITTED WITH SURFACE CLAMPS

This application is a continuation-in-part of application U.S. Ser. No. 08/507,259, filed as PCT/US94/01777, Feb. 22, 1994 published as WO94/19272, Sep. 1, 1994, now abandoned.

FIELD OF THE INVENTION

The present invention relates to excavating equipment particularly to such equipment for use in excavating a relatively deep hole of substantially rectangular cross-section shape for use in the formation of support piles or the like or in the excavation of elongated trenches or ditches for use in the preparation of foundation elements or for the construction of diaphragm walls.

BACKGROUND OF THE INVENTION

Known equipment for use in such forms of excavation have generally involved the use of very tall cumbersome cranes from which are suspended heavy support structures which carry at their lowermost ends suitable excavating equipment such as clamshells or milling cutters or the like. Clearly the use of such tall cranes is very cumbersome and is restricted to sites readily accessible by such large cumbersome equipment. Furthermore, such tall cranes require significant power sources for their operation. Furthermore, with such known equipment, preliminary holes or trenches have to be prepared which are subsequently penetrated by the excavating equipment and these preliminary holes or trenches have to be suitably reinforced so as to prevent their collapse during the excavation procedure.

It is a furthermore known disadvantage with such equipment that, in order to ensure that the excavated holes or trenches are maintained in a stable condition prior to the casting therein of the concrete or the like, the holes as they are being excavated must constantly be filled with a substance such as that known as bentonite which must be subsequently pumped out during the concrete casting procedure.

There have been disclosed in the Applicant's prior patent specifications U.S. Pat. Nos. 4,957,175 and 4,770,256 soil drilling equipment wherein some of the above-referred to disadvantages are reduced in that, during the drilling procedure, pressure plates are forced against the walls of the hole as they are being drilled, in this way leading to the compacting of the walls and reducing the dangers of collapse. Such prior proposals do not, however, lend themselves readily for use in equipment other than soil drilling equipment for the production of relatively narrow bore holes. In particular, they do not disclose any particular solution for the problem where the excavation to be effected is of substantially rectangular cross-section using for this purpose clamshell excavators or rotary mill cutters or the like.

U.S. Pat. No. 3,357,506 to Bosredon discloses a drilling apparatus comprising a suspension mechanism with a pair of shells for drilling a cylindrical shaft, and guide plates adapted for applying radial pressure on the shaft walls in order to prevent vertical motion of the apparatus in response to reaction forces. However, the arrangement according to this patent has several drawbacks. First, and most important, when excavating is performed in soil having high penetration resistance, e.g. in solid or heavy soils or rock-rich soil, the shells will not succeed in penetrating the soil and the guide plates will slide along the shaft's walls. The outcome of he above is that only positive penetration means (i.e, drilling shells) are suitable for use with this apparatus, and indeed it does not suggest rectangular cross-sectional shaped bores or trenches. Second, the sheer forces acting on the guide plates may cause severe damage to the lateral expansion means thereof. Another drawback resides in that the shape of the guide plates has to be consistent with the cross-sectional contour of the projected shaft and thus, replacing drilling shells requires simultaneous replacement of guide plates.

It is therefore an object of the present invention to provide a new and improved excavating equipment in which the above-referred to disadvantages are substantially reduced or overcome and the above-referred to desiderata are substantially fulfilled.

BRIEF SUMMARY OF THE INVENTION

According to the present invention there is provided excavating equipment comprising a rigid support structure; surface clamping means articulately mounted on said support structure; excavating means downstream of said surface clamping means in a direction of excavation; said surface clamping means being substantially as wide as said excavating means; means for urging the excavation means in direction of excavating and during excavating; power means coupled to said excavating means for operating same and for operating said urging means, said power means being also coupled to said surface clamping means for laterally displacing said clamping means against rigid supporting surfaces so as to generate a counter-reaction to forces generated by operation of said excavating means; and equipment displacing means coupled to said support structure for displacing said equipment into and out of an excavation.

Preferably the excavation means comprises a pair of clamshell buckets reciprocally pivotable about substantially parallel pivotal axes towards and away from each other under the influence of the power means.

Said urging means being connected at one end thereof to the support structure and at an opposed end thereof to said excavation means, wherein said clamshell buckets are pivotally linked at a bottom end of the urging means. Preferably, said urging means is a set of hydraulically operated urging pistons disposed parallel to the direction of excavating wherein said power means activating the clamshells are hydraulically operated pistons disposed at angle with respect to said urging pistons.

In accordance with a preferred embodiment of the invention, the surface clamping means comprises a pair of substantially planar pressure plates located substantially normally to the pivotable axes of the clamshell buckets. If desired, a further pair of substantially planar pressure plates located substantially parallel to the pivotable axes are provided.

The invention also envisages the provision of compact, mobile structures capable alternatively of operating in confined places or in the vicinity of existing structures such as walls or the like or in open spaces. These compact structures are provided with means whereby preparatory bores or recesses can be formed by the excavating means themselves with the pressure plates being pressed against the walls of these preparatory recesses as excavation proper begins.

In accordance with an alternative preferred embodiment of the present invention, there is provided a first rigid support structure; surface clamping means articulately mounted on said first structure; power means coupled to said surface clamping means for displacing said clamping means against rigid supporting surfaces; a second rigid support structure articulated to said first structure; rotary milling cutters mounted on said second structure; means for urging said second structure in the direction of excavating during excavating; said surface clamping means being substantially as wide as the diameter of both milling cutters; power means coupled to said rotary milling cutters for operating same, forces generated during operation of said excavation means being countered by a counter-reaction generated by displacement of said clamping means against said supporting surfaces.

DESCRIPTION OF THE DRAWINGS

For better understanding, the invention will now be described, by way of example only, with reference to the accompanying drawings in which.

DETAILED DESCRIPTION OF SPECIFIC EMBODIMENTS

Figure 2:
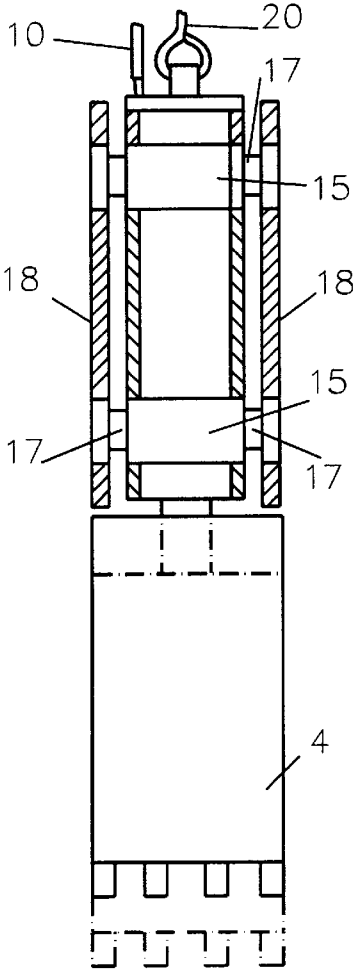
FIG. 2 is a cross-section along line II—II in FIG. 1.
Figure 1:
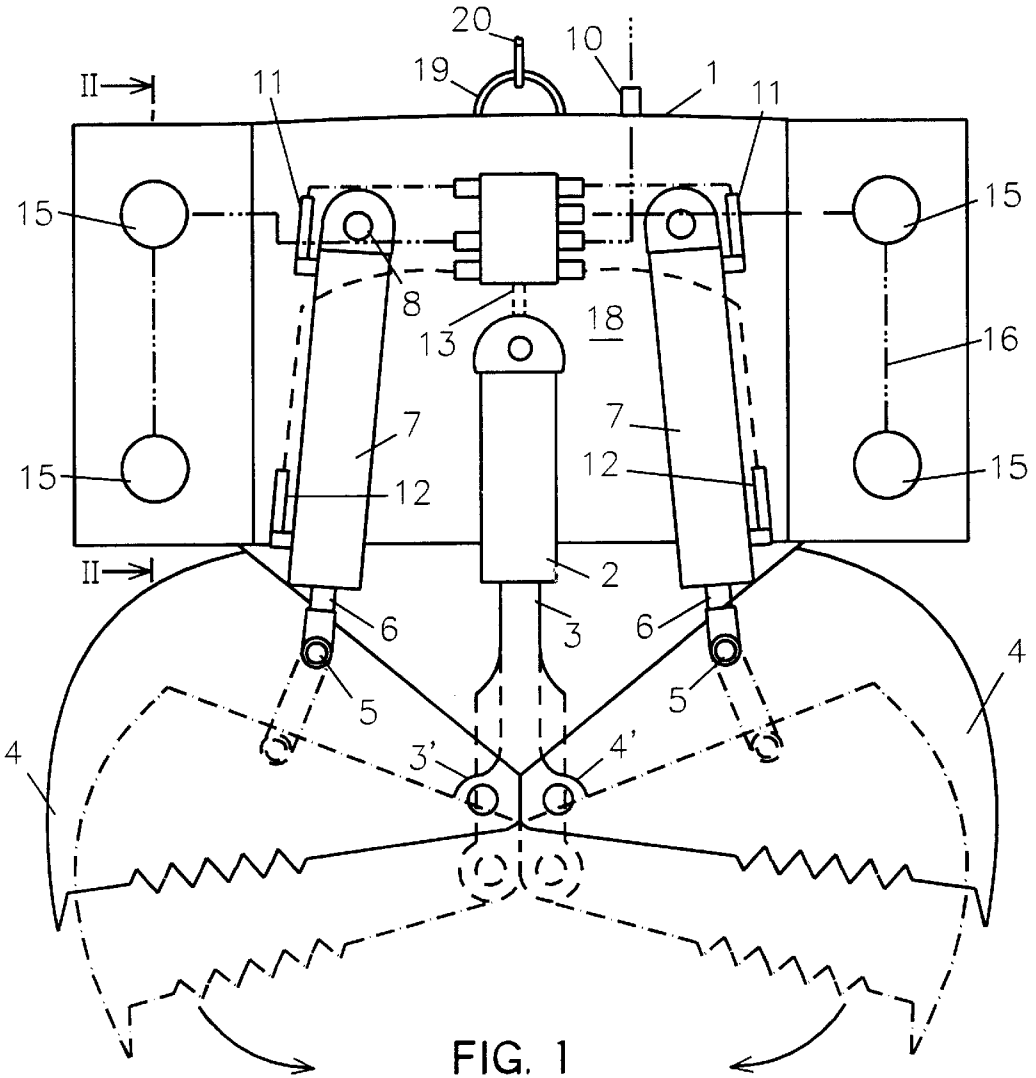
FIG. 1 is a front elevation of a clamshell type excavating apparatus according to the present invention with the front pressure member removed and with the buckets in two sequencing positions.
Figure 3:
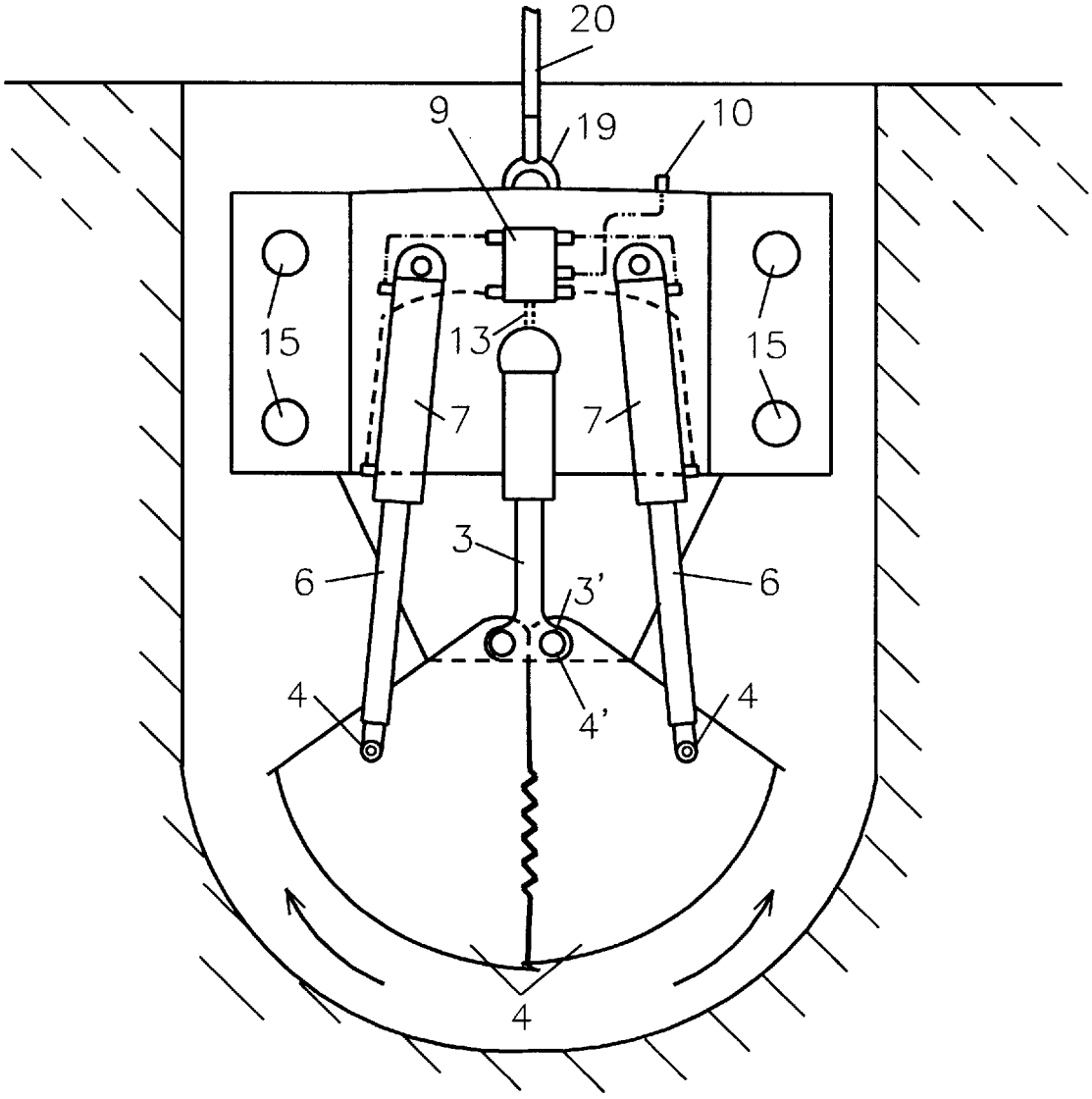
FIG. 3 shows the excavating apparatus suspended within a partially dug excavation with the buckets in their closed position.

Reference is first being made to FIGS. 1 to 3 of the drawings in which a clamshell type excavating equipment consists of rigid support structure 1 with an essentially vertically extending hydraulic cylinder 2 attached thereto and having a piston rod 3 with an end plate 3'. Two clamshell buckets 4 or shovels are pivotally articulated about pivotal axes 4' to the end plate 3' each of the buckets being also pivotly linked at 5 to piston rods 6 of hydraulic cylinders 7 which pistons are themselves pivotly linked at their opposed end 8 to the structure 1.

A hydraulic control unit 9 is connected via fluid pressure supply line 10 to a power source (not shown) and has a first pair of conduits 11 connected to one end of the cylinders 7 and a second pair of conduits 12 connected to an opposite end of the cylinders. A third conduit 13 is connected to the vertical piston 2 for extending the piston rod 3.

The arrangement is such that upon directing pressurized fluid through conduit 12 and out of conduits 11, the piston rods 6 retract into the cylinders 7, whereby, the buckets 4 move into their opened position as illustrated by solid lined in FIG. 1 and upon directing pressurized liquid through conduits 11 and out of conduit 12, the piston rods 6 extend out of the cylinder 7 and the buckets 4 move to their closed position as illustrated in FIG. 3. When hydraulic pressure is directed via conduit 13 the piston rod 3 extends out of the cylinder 2 and the pivotal axes 4' of the buckets 4 move downward, with consequential descending of the buckets, to the position illustrated by dashed lines in FIGS. 1 and 2.

Two pairs of cylinders 15 are mounted on respective ends of the support structure 1 with their longitudinal axes parallel with the axes 4' of the buckets 4 and are connected via conduits 16 to the hydraulic control unit 9. Each cylinder 15 has two axially opposed cylinder rods 17 (see FIG. 2) to which are connected vertical pressure plates 18 (both seen in FIG. 2 but for the sake of clarity of understanding one of the plates is shown removed in FIGS. 1 and 3). The width of the pressure plates 18 is substantially equal to the width of the buckets 4 or as wide as the span of the buckets in their opening position. The arrangement is such that upon application of hydraulic pressure to the cylinders 15, the cylinder rods 17 extend and the pressure plates 18 are displaced apart whereas upon retraction of the cylinder rods 17 the pressure plates 18 come together.

The support structure 1 further has at its top end a hoisting ring 19 for connecting a hoisting cable 20.

For excavation, the equipment is brought to the site where it is required and where an initial shallow hole has been prepared by known means. Such a preparatory hole should be deep enough so as to accommodate the pressure plates 18 of the excavating equipment. Then, the equipment is lowered into the preparatory hole by any suitable hoisting means and with the buckets 4 in their open position, and hydraulic pressure is applied from an external power source (not shown) through supply line 10 and conduits 16 and to pistons 15, whereby, the pistons expand resulting in the pressure plates 18 clamping against the walls of the preparatory hole thereby forcing the equipment in position.

Hydraulic pressure is applied through conduits 11 and 13, to the cylinders 7 and 2 respectively, resulting in the buckets 4 pivoting towards one another and simultaneously descending as illustrated by the arrows in FIG. 1, thus digging into and gathering up excavated soil. The pistons 15 are contracted releasing the pressure plates and the excavation equipment is hoisted by the cable 20 and the excavated soil is removed by suitable known means. The equipment is again lowered deeper into the excavation to perform another sequence of excavating as described above.

It should be appreciated by the artisan that descending of the axes 4' results in additional force applied on the buckets 4 in direction of the excavation, whereby on the one hand improved penetration of the buckets into the soil is obtained, particularly in condensed or rocky soils, and on the other hand, sheering forces on various components of the apparatus is reduced.

Where it is desired to excavate an elongated ditch or trench, a preparatory correspondingly elongated shallow trench is prepared and excavation proceeds gradually in a direction parallel to the planes of the pressure plates. Alternatively pairs of separated holes can be excavated and subsequently the bounding region between the excavated holes is excavated. Where required, the elongated trench can be of any required shape.

Each time the pressure plates 18 are pressed against the walls of the excavation, the walls are continuously compacted, whereby, caving in and creeping of the excavation walls are avoided. This feature renders the use of the excavating equipment highly cost effective.

Furthermore, by adding suitable gauges responsive to the stroke of the piston rods 17 and to the pressure within conduits 16, it is possible to determine any lateral dimensional changes of the excavation walls as well as their compressibility which generates a real time indication regarding compactness of the soil and indicating whether cavities exist or caving in has occurred during excavating.

Figure 4:
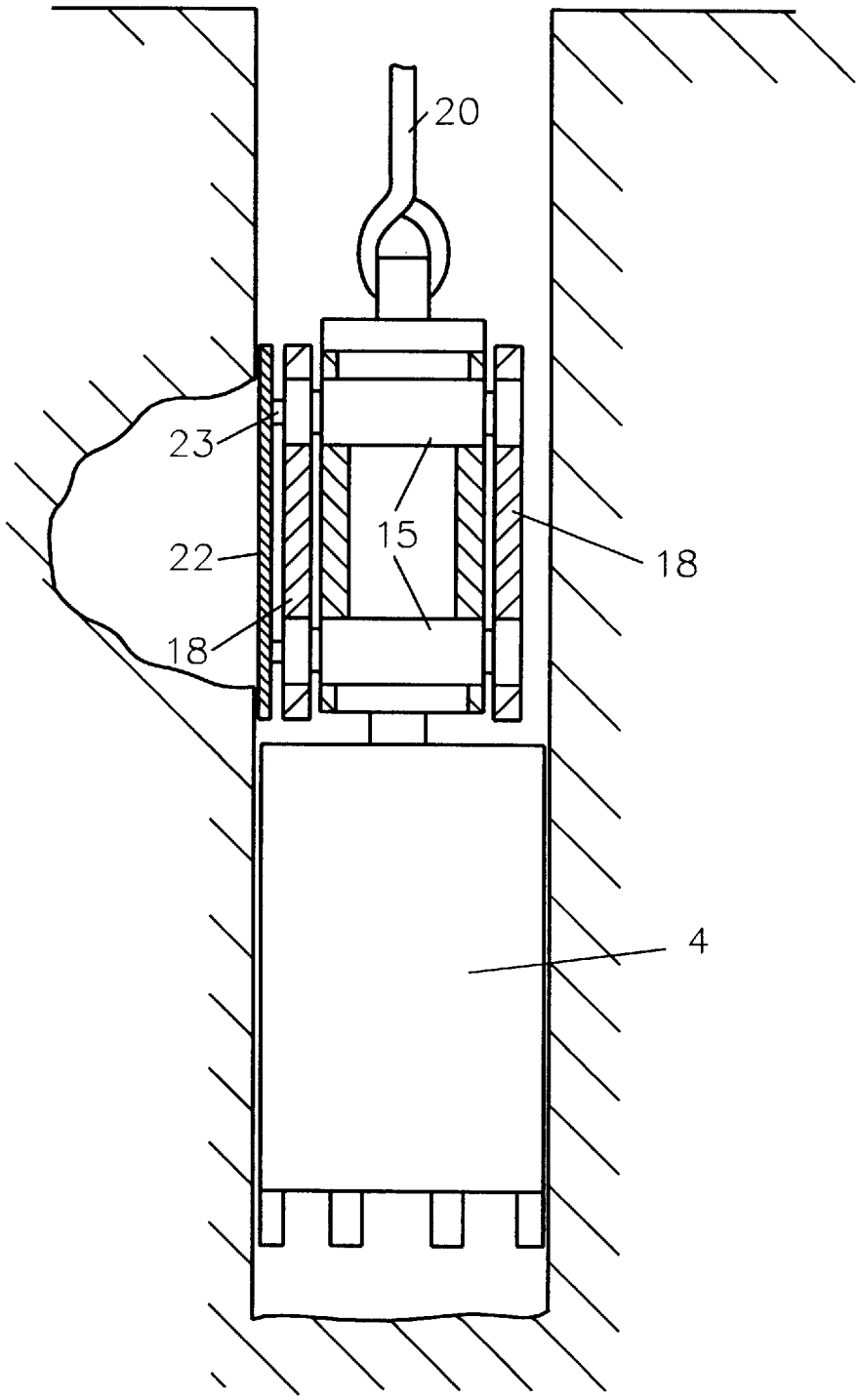
FIG. 4 illustrates how the present invention may be used for plating walls of an excavation.

For the eventuality that caving in has occurred, or if a pre-existing cavity was detected during the excavation, as illustrated in FIG. 4 of the drawings, a concrete plating board 22 or other suitable material can be attached by readily detachable catches 23 to one of the pressure plates 18 and the excavating equipment is lowered to the correct depth and the pressure plate 18 with the attached plating board 22 is extended so the latter is pressed until it becomes flush with the wall of the excavation, covering the cavity and straightening the wall of the excavation. This enables a diaphragm wall of uniform thickness to be cast without the formation of excessive concrete bulges in such cavities.

By way of another application of the invention, the equipment may be used not only for compacting and plating the walls of an excavation as already explained, but also for improving stabilization of the walls by pressing a metal net or stabilizing granular materials such as gravel, into the walls.

Figure 5:
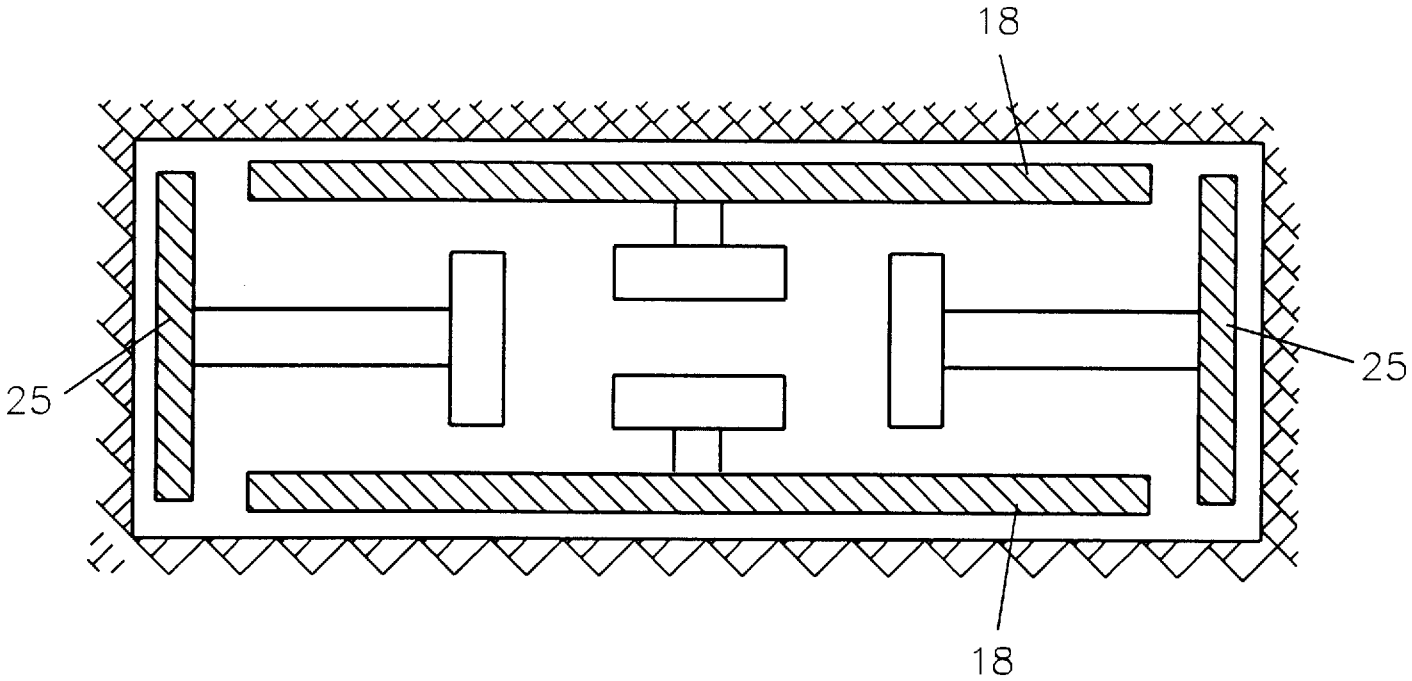
FIG. 5 is a schematic cross-sectional illustration of another embodiment of the excavating apparatus shown within a bore.

Reference is now made to FIG. 5 which is a schematical top view of an apparatus according to the present invention which comprises two pairs of opposed pressure plates 18 and 25, respectively located in planes perpendicular to each other. The first pair 18 (bearing the same reference numeral as in FIG. 2) lies in a plane parallel with the plane of swinging of the buckets 4 and the second pair 25 is disposed perpendicular to the first pair. This arrangement is for use in excavating holes of a width not exceeding the maximum span of the buckets 4 and the maximum expansion of the pistons of the side pressure members 25. However, by using such pressure members in two normally directed axes, as illustrated, an excavation is obtained in which all the walls are compacted.

Figure 6:
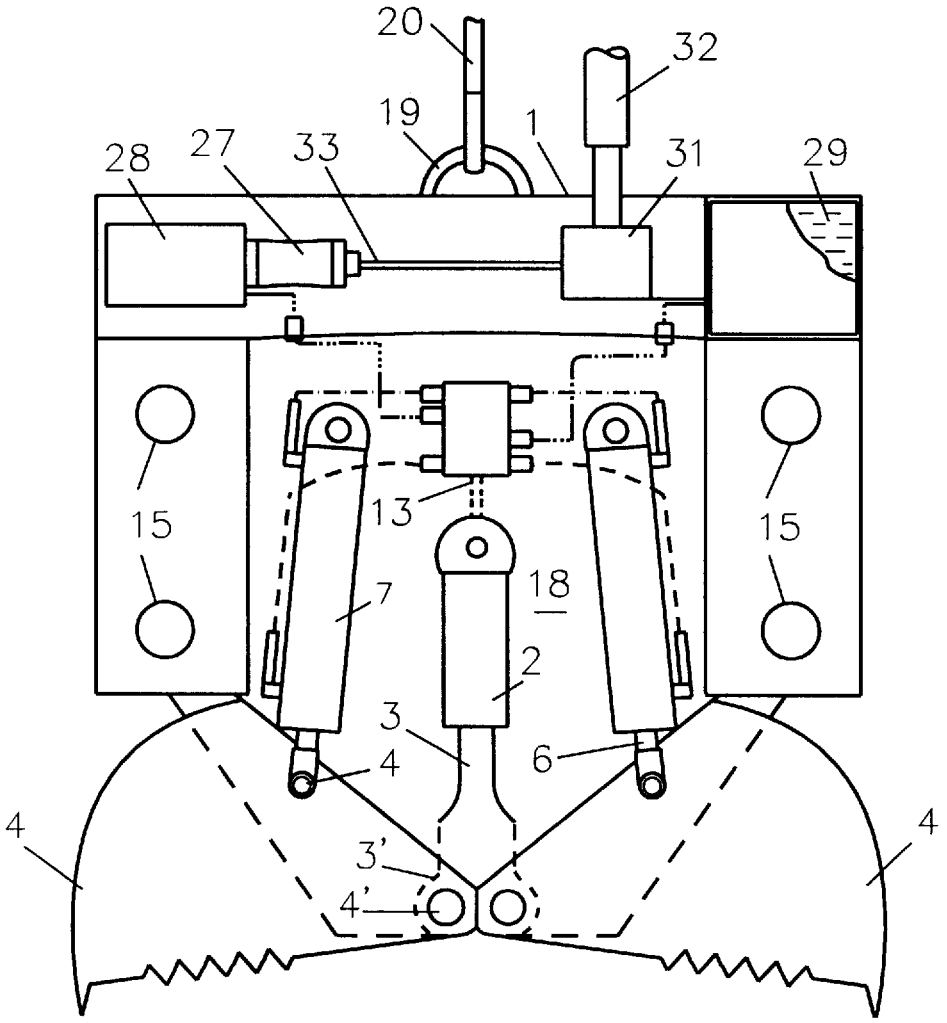
FIG. 6 is another embodiment of the present invention.

Attention is now made to FIG. 6 which is a modified form of the present invention in which those elements which are similar to those of the embodiment of FIG. 1 are designated with similar reference numerals.

According to this embodiment, the rigid support structure 1 accommodates an electric motor 27 connected to an hydraulic motor 28, a pressure fluid reservoir 29 and an electric control unit 31 adapted to receive signals from the operator either by an electric cable 32 or by transmitted signals, whereby electric signals are yielded by the control unit and transferred to the electric motor 27, by means of an electric cable 33. The advantage of this embodiment is that less energy is lost throughout the long hydraulic lines 10 of the previous embodiment of FIG. 1 and where the commands are transmitted to the electric control unit 31, the need for a collecting pulley is obviated.

Figure 7:
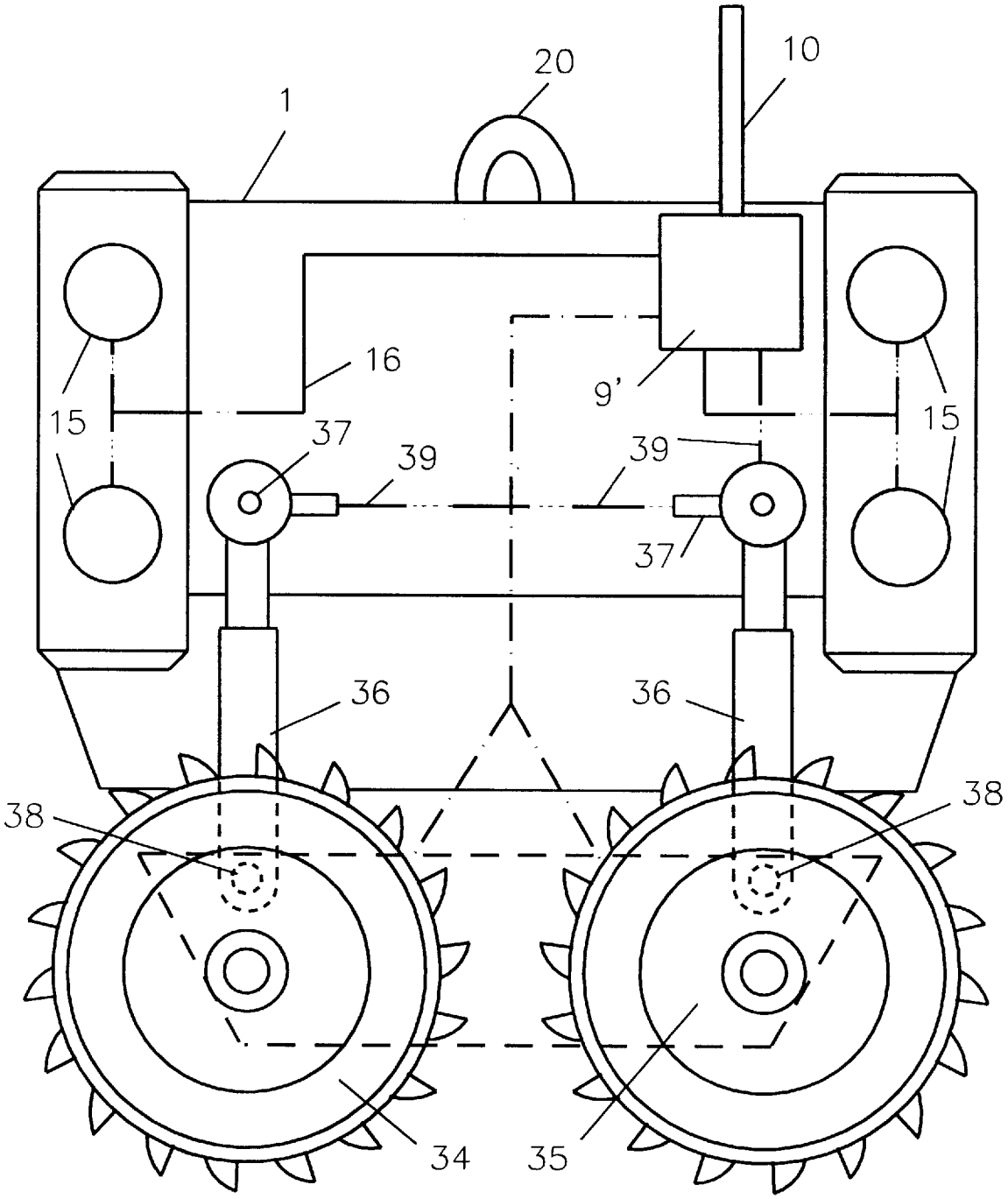
FIG. 7 is another embodiment according to the invention in which the excavating means is a soil milling cutter.

FIG. 7 of the drawings shows how the present invention may be applied to excavating equipment employing soil milling cutter also known as a hydromill, useful for excavating in hard soil or in rocky sites. For the sake of simplicity, similar elements are marked with the same reference numerals as in FIGS. 1 to 3. In this embodiment, the excavating is performed by two soil milling cutters 34 rotatably mounted on a second rigid structure 35 vertically disposed bellow the first rigid structure 1 and connected thereto by two vertical pistons 36, the overall extent of the milling cutters being substantially equal to the width of the pressure plates 18, or slightly larger. Each of the pistons is connected at a top end 37 to the first rigid structure and at a bottom end 38 to the second rigid structure 35 and is provided with a hydraulic conduit 39 for vertically expanding or contracting the pistons 36, thereby vertically displacing the second rigid structure with respect to the first rigid structure. The milling cutters are driven by hydraulic motors (not seen) in opposed directions, the motors receiving fluid pressure via conduits 39*a*.

The apparatus further comprises, as in the previous embodiments, pressure plates 18 (one of which is shown removed for the sake of clarity) which can be expanded or contracted by means of hydraulically operated pistons 15. A hydraulic control unit 9 provided with pressure inlet conduit 10 and outputs 16, 39 and 39*a* is provided for controlling the expansion-contraction of the pistons 15 and 36 and the operation of the mill cutters 34 by their respective motors. In accordance with such an embodiment, the excavated soil is removed from the dig by flushing means (not shown) as known by those skilled in the art.

An excavating procedure is performed as already explained, by first digging a preparatory hole deep enough to accommodate the pressure plates and then as the milling cutters 34 are rotated, they are gradually lowers by expanding the cylinders 36, thus deepening the dig while clamping the pressure plates against the walls of the dig.

Figure 8:
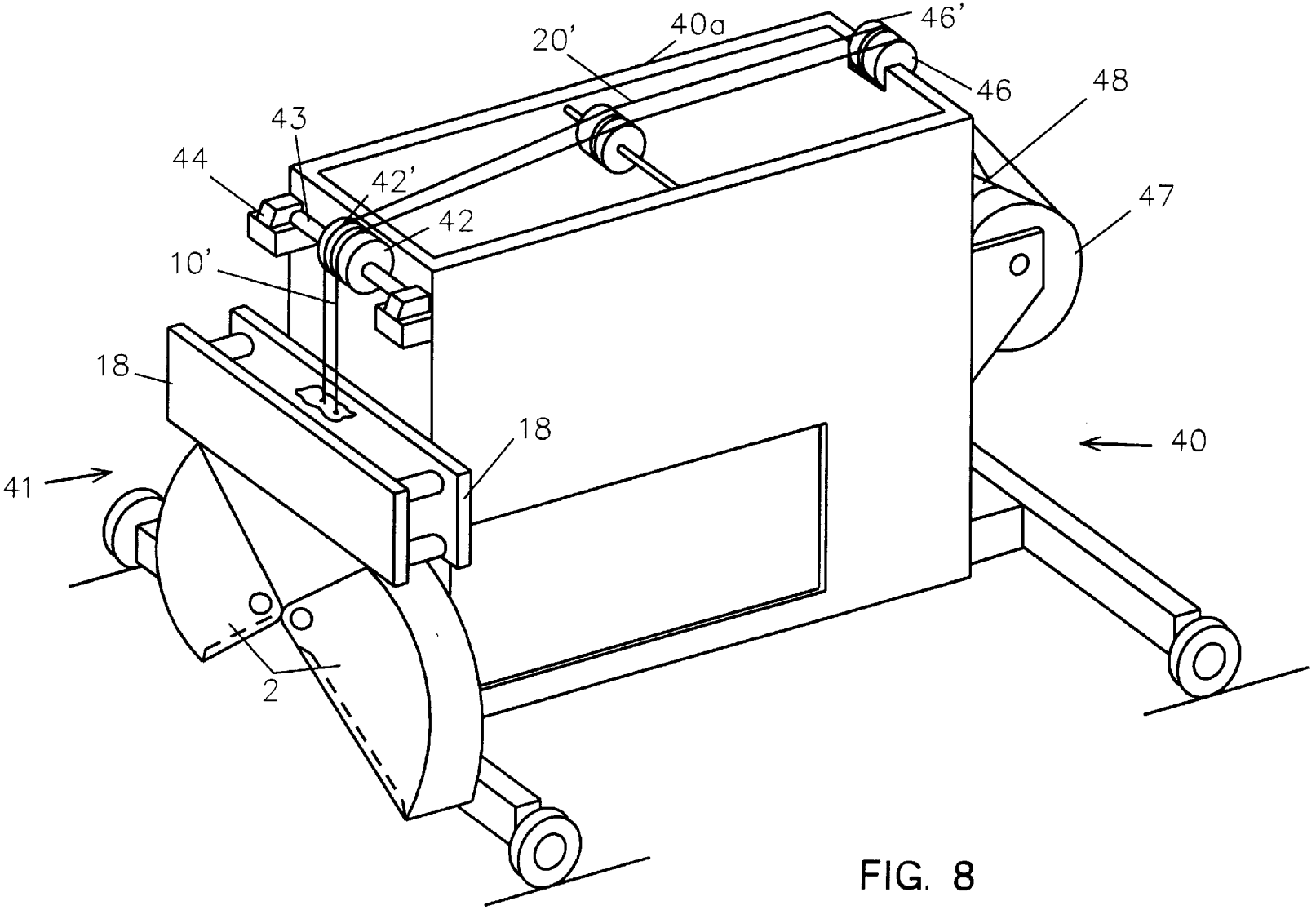
FIG. 8 is an isometric view of a structure suitable for suspending the excavating apparatus shown in a first suspending position.
Figure 9:
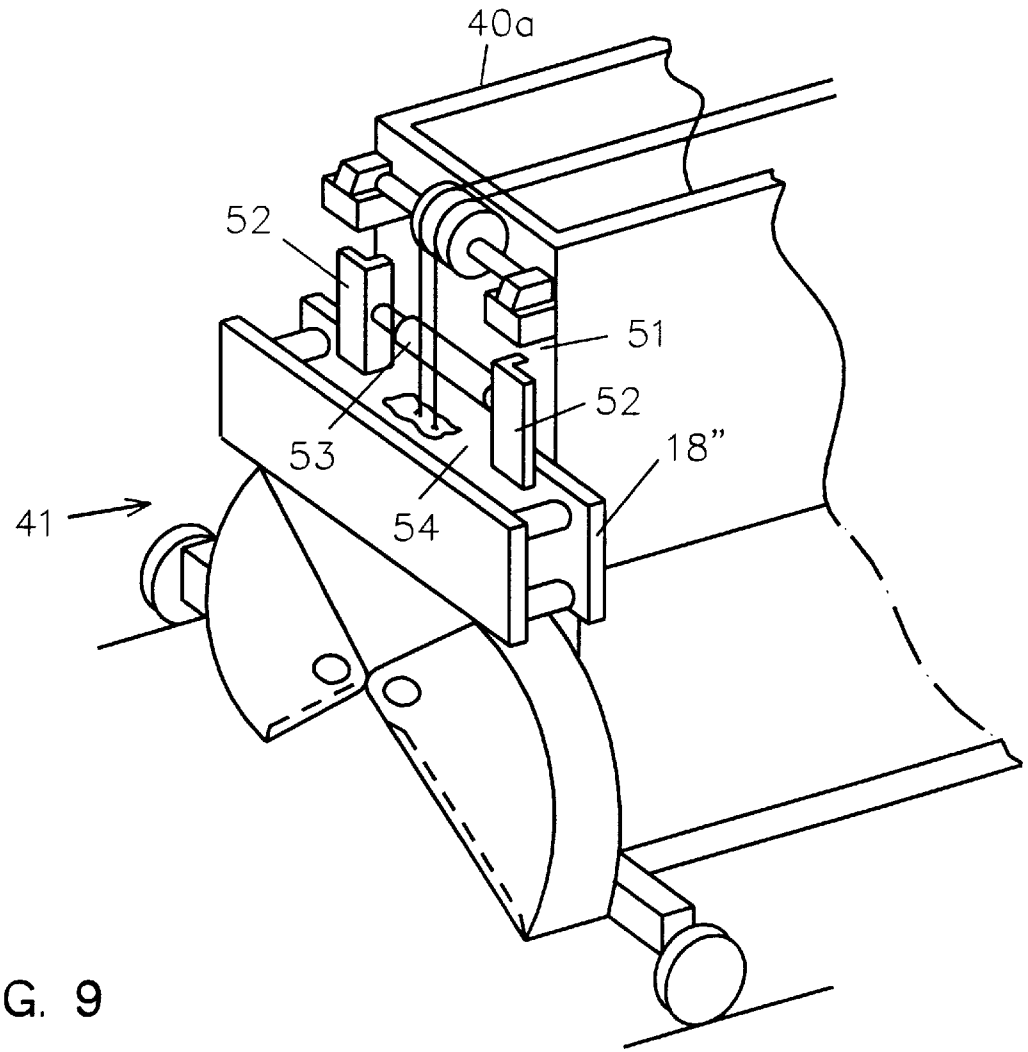
FIG. 9 is a partial cutout view of another embodiment as in FIG. 8.
Figure 10:
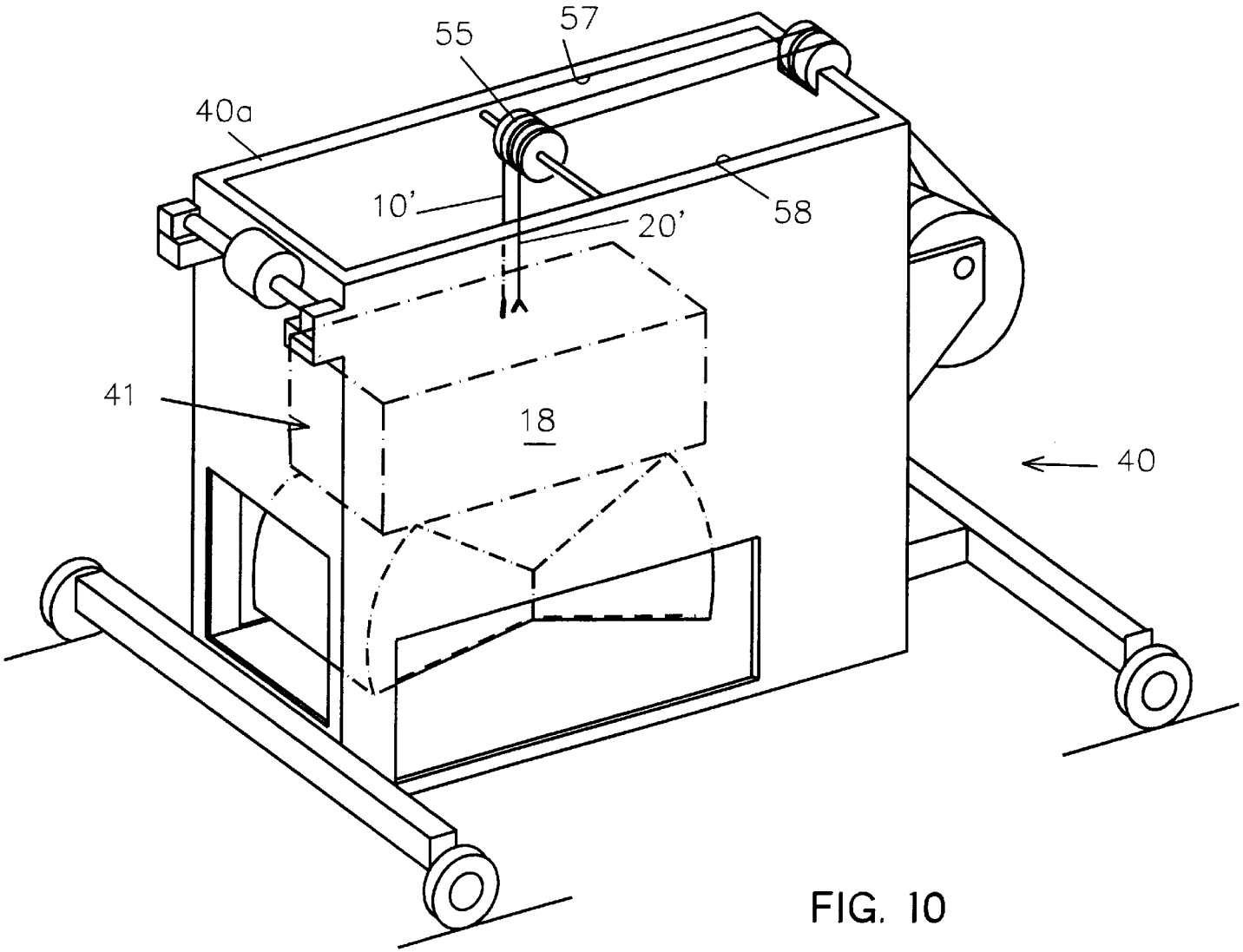
FIG. 10 is a structure of FIG. 8 in a second suspending position.

Reference is now made to FIG. 8 to 10 in which are illustrated a mobile constructions 40 for use in alternative modes of excavation as will hereinafter be explained and which effectively cope with the preparation of the initial hole or trench.

In a first mode of excavating, as illustrated in FIG. 8, the construction is used when it is required to excavate adjacent a vertical existing structure such as a wall. In this case, the excavating equipment generally designated 41, is mounted on a rigid boxlike structure 40*a* and is suspended by cable 20' from a first pulley 42 and over a second pulley 46. A hydraulic supply line 10' runs parallel with the cable 20' and rolls over pulleys 42' and 46' respectively. As illustrated, the cable 20' and the supply line 10', are picked up by winch 47 and pickup spool 48, respectively. The power required for the winch and for pressurizing liquid through the supply line is obtained from any power source of any known type integral with, or separate from the mobile construction and not shown in the figures.

This mode of excavation is carried out by locating the construction 40 with the excavating equipment 41 adjacent the vertical structure (not shown) and over a preparatory hole dug beforehand (not shown) and then, proceeding as already explained, with the pressure plates 18 clamping against the walls of the excavation.

Alternatively, and as illustrated in FIG. 9, there is mounted on an external wall 51 of the boxlike rigid structure 40*a* two counter reaction members that are embodied by laterally slidable brackets 52 with an expanding pressure member 53 therebetween, adapted for expanding or contracting the brackets 52 within a suitable slot 54 in the pressure plate 18" facing the construction, which together with the brackets 52 forms a dovetail arrangement.

With this arrangement, it is possible to form the initial preparatory bore or trench by means of the equipment's clamshell buckets themselves which are actuated into an excavating condition with the necessary counter-reaction being obtained by the brackets 52 clampingly locking within the slot 54 of the pressure plate 18". The construction is stabilized by its self weight or, if necessary, by additional anchoring means as known in the art.

In a second mode of operation, the construction is used for excavating in obstacle free ground. According to this mode, illustrated in FIG. 10, the excavating apparatus 41 is accommodated within the framework of a boxlike rigid structure 40*a* and is suspended from a pulley 55 with the hydraulic supply line 10' running parallel to the cable 20' and rolled by a winch and a spool respectively, by means of any suitable power source as already explained.

In operation, after locating the construction in the site of excavation and anchoring it if necessary (e.g. in case of hard or rocky land), the excavating apparatus 41 is lowered to the ground's surface and the pressure plates 18 are expanded to clamp between the inner walls 57 and 58 of the construction, whereby, a counter-reaction is obtained, enabling the excavating apparatus to penetrate into the ground, and in this way effecting the preparatory hole.

It should be realized that the power source may be integral with the mobile structure 40, or be a separate stationary power source. Alternatively, power from any heavy machinery such as tractors or cranes may be obtained. It should also be realized that the construction may also be provided with a soil collecting means as known in the art but not described and not seen in the drawings. Furthermore, for digging ditches, the construction may be wheeled over rails located along the route of the ditch (not shown).

The small dimensions of the construction enable it to be operated also in confined places such as basements, caves or tunnels, or places with poor accessibility which may require transferring the equipment by helicopter.

Figure 11:
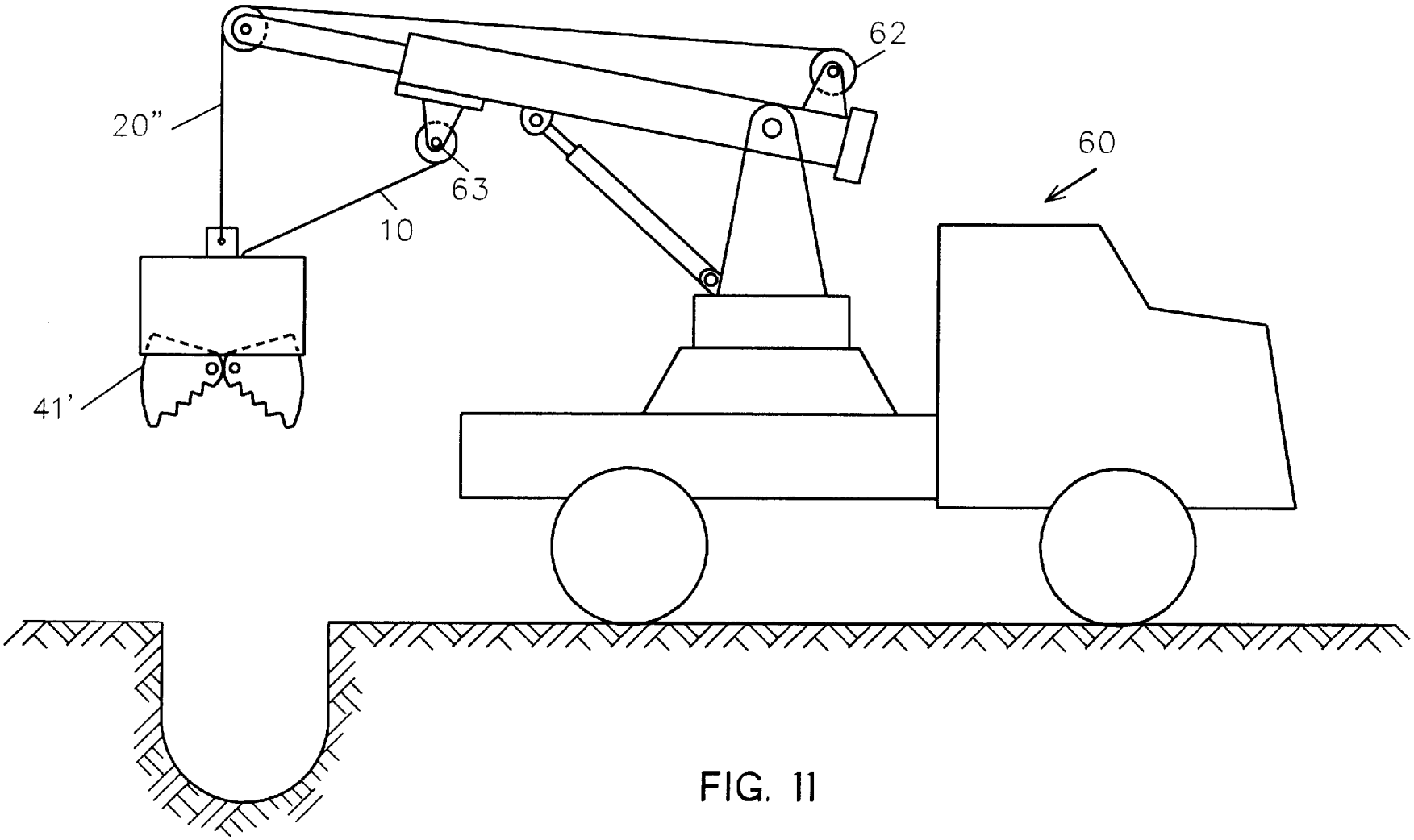
FIG. 11 shows how the present invention may be attached to a conventional tow truck.
Figure 12:
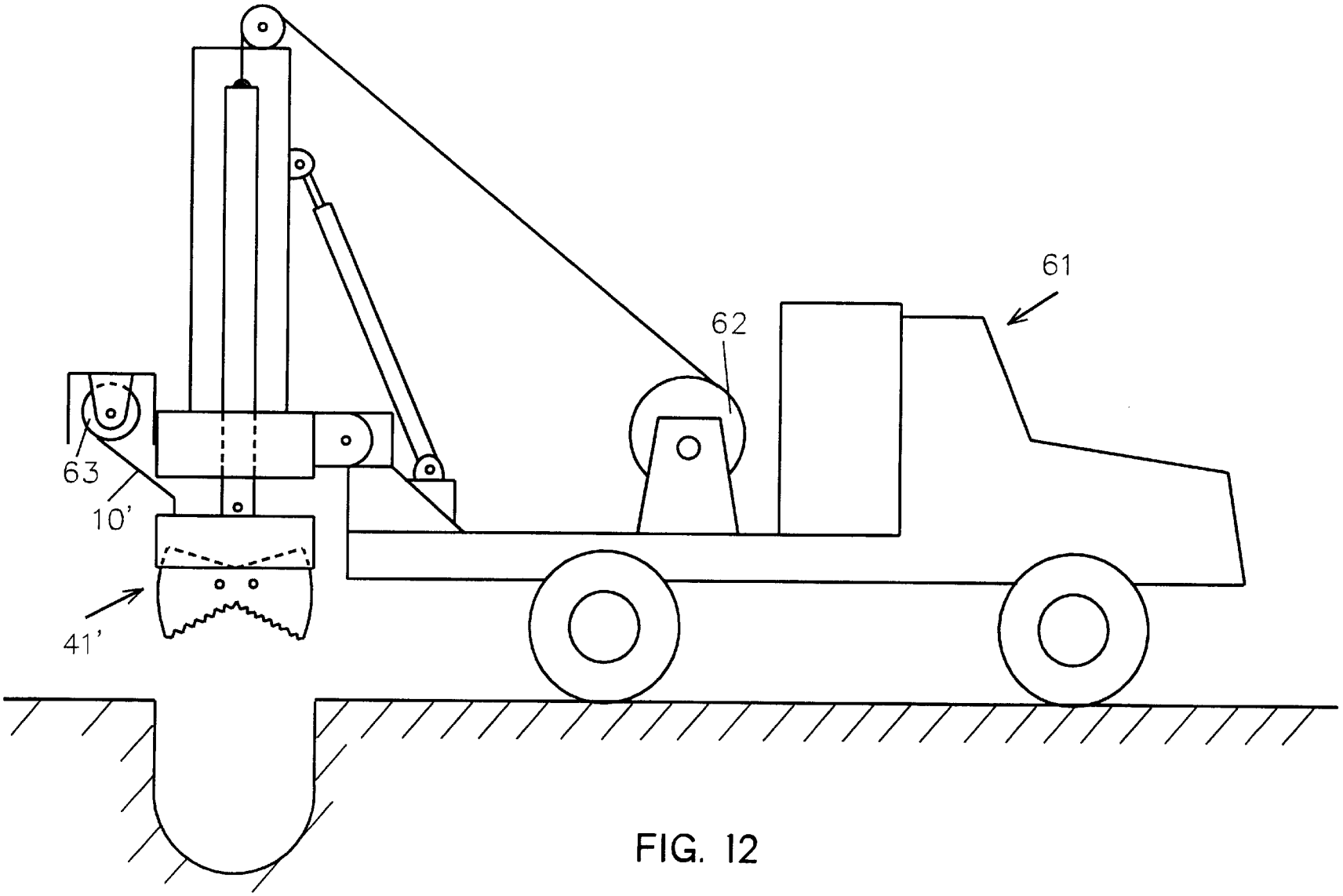
FIG. 12 illustrates how the invention may be mounted on a drill truck.

In the embodiments of FIGS. 11 and 12, it is shown how the excavating apparatus 41' may be attached to a tow truck 60 or to a drilling truck 61 respectively, making use of their integral winch 62 and hydraulic system, by adding, if required, a pulley 63 for collecting the hydraulic supply line 10'.

Figure 15:
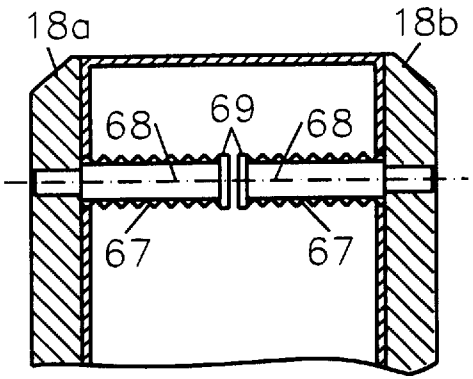
FIG. 15 is a cross-section along line xv—xv in FIG. 13.
Figure 14:
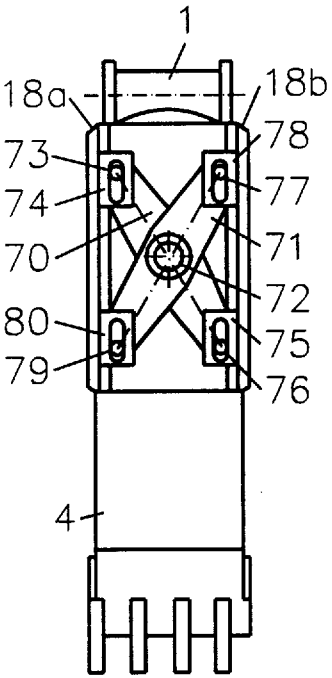
FIG. 14 is a side view of the embodiment of FIG. 13.
Figure 13:
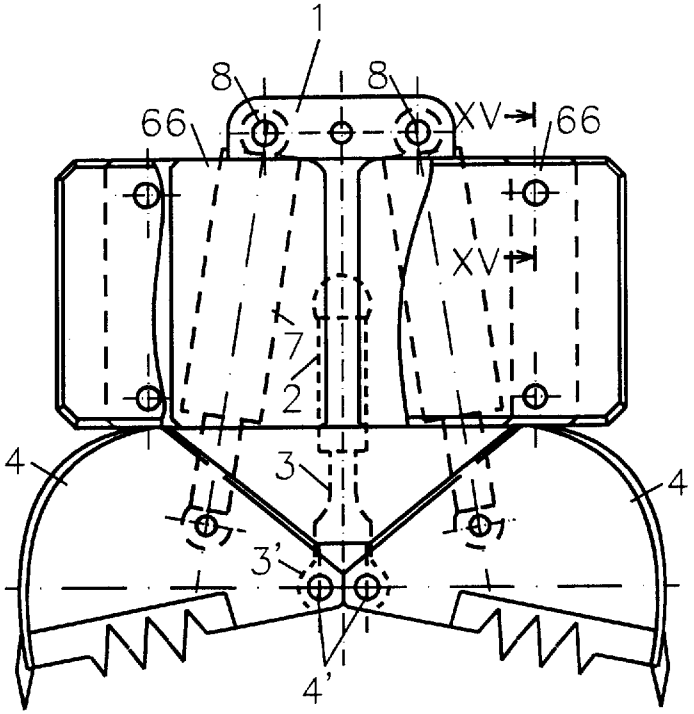
FIG. 13 is a front view of a further embodiment of the present invention.

FIGS. 13 to 15 are a further modification of the embodiment shown in FIG. 1, in which those elements which are similar to those of the embodiment of FIG. 1 are designated with the same reference numerals.

In this embodiment, expansion and contraction of the pressure members 18*a* and 18*b* is obtained by two pneumatic inflatable-deflatable air cushions 66 disposed between the pressure members 18*a* and 18*b* which pressure members are biased towards one another by a plurality of belleville springs 67 mounted on guide rods 68 and bearing at one end against a shoulder 69 of the rods and at the other end, against the pressure members (see FIG. 15).

Accordingly, when it is required to expand the pressure plates, the air cushions 66 are inflated by a pneumatic pressure line (not shown) overcoming the biasing effect of the belleville springs 67. Now, when it is required to contract the pressure plates, the air cushions 66 are deflated and the bevelled springs 67 bias the pressure members into their contracted positions.

In order to guarantee that the pressure members remain constantly parallel with one another, the equipment further comprises a mechanism consisting of two crossed links 70 and 71 (as seen in FIG. 14) pivotly linked to one another at their centers 72. The first link 70 is linked at its top end 73 to bracket 74 of pressure member 18*a* and at its bottom end 75 to brackets 76 of pressure member 18*b*. The second link 71 is linked at a top end 77 to bracket 78 of pressure member 18*b* and at its bottom end 79 to bracket 80 of pressure member 18*a*. This arrangement ensures that the pressure members 18*a* and 18*b* remain constantly parallel with one another and that their axial displacement is identical.

Digging according to this embodiment is carried out in the same manner as already explained regarding the previous embodiments.

The present invention may also be used for constructing lateral brackets integral with a load bearing element or a diaphragm wall, useful for example for supporting ready made ceiling or floor elements.

Figure 16:
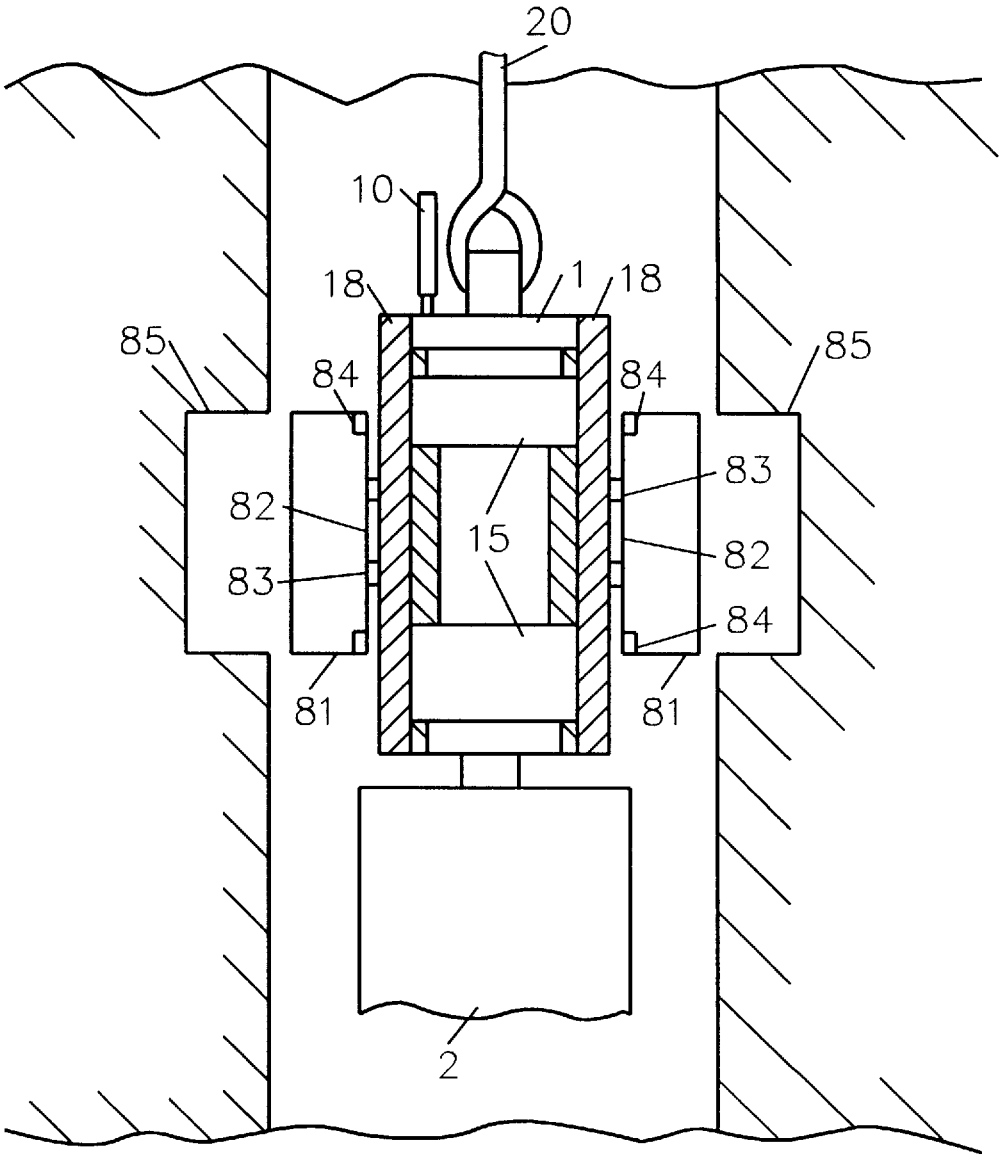
FIG. 16 is a cross-section illustrating how lateral brackets may be produced in diaphragm walls, employing the present invention.

In FIG. 16, two hollow boxlike elements 81 have their walls 82 releasably attached by fasteners 83 to the respective pressure members 18. Thus the walls 82 are radially detachable from their respective boxes 81 by means such as solenoids 84, although prior to detaching, the walls 82 are rigid with the boxlike elements 81.

The arrangement is such that after excavating a wide enough hole, the apparatus with the boxes 81 attached thereto (as in FIG. 16) is lowered to the required depth, and then, the expansion means are expanded until the pressure members 18 encounter the inner walls of the excavation. At this stage, the boxlike elements 81 continue their penetration into the earth until they are detached from their walls 82 by activating the detaching members 84. Then, the pressure members 18 are contracted and the apparatus is lifted from the excavation, leaving in place the open boxes 81, thus forming niches in the ground which upon casting with cement, will form the lateral brackets 85 which may be employed for supporting ready made ceilings or floors.

Figure 17:
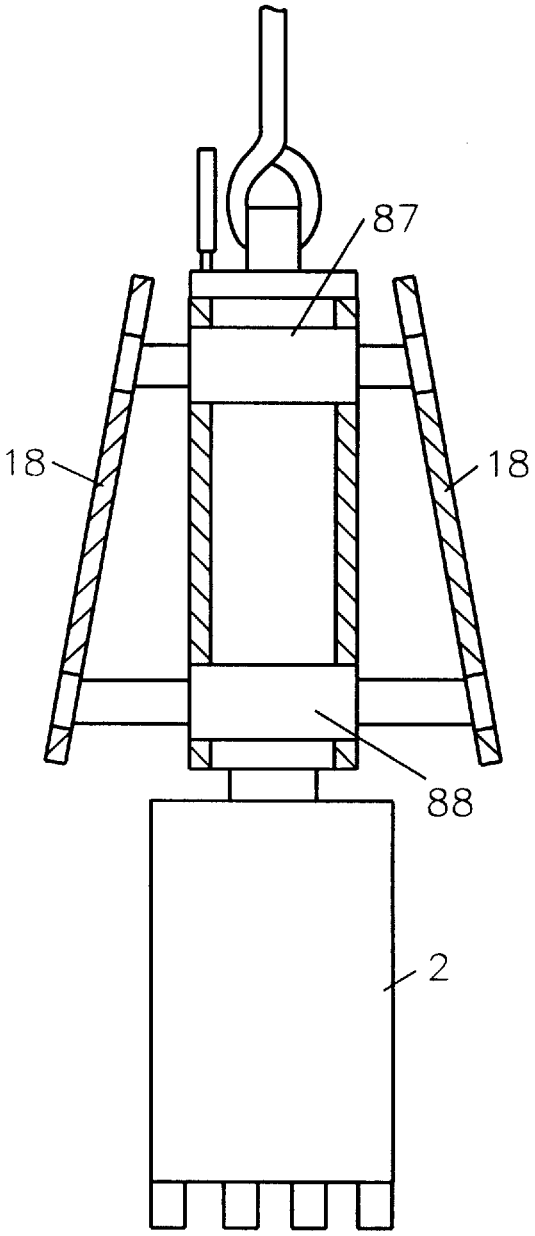
FIG. 17 illustrates how the present invention is used for casting strengthened load bearing elements.
Figure 18:
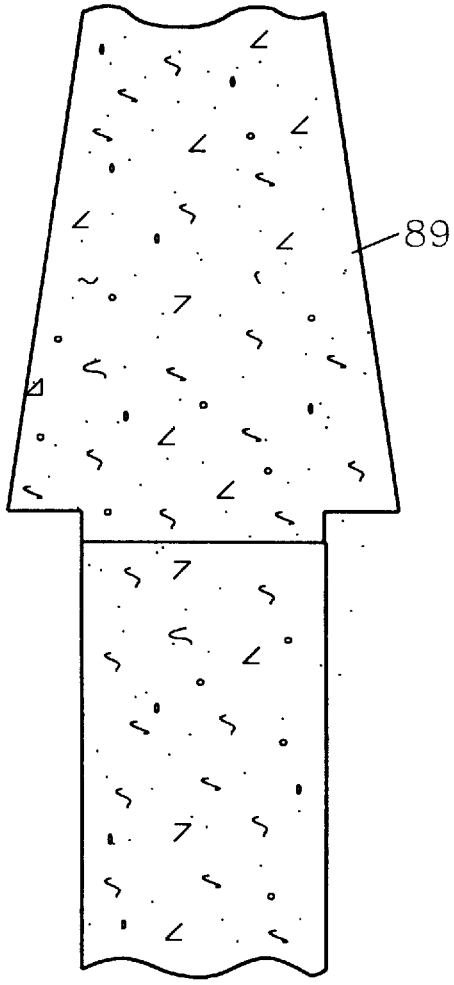
FIG. 18 is a cross-section of a strengthened bearing element prepared according to the embodiment of FIG. 17.

FIGS. 17 and 18 illustrate how the invention may be used for preparing load bearing elements of a reinforced structure. According to this modification, in which similar elements were given the same reference numerals as in the previous embodiments, the pressure plates 18 are connected to a first pair of pistons 87 (only one seen) and a second pair of pistons 88 below said first pair 87.

The arrangement is such that the stroke of said second pair of pistons 88 is greater than that of said first pair of pistons 87, whereby, when the pressure plates 18 are pressed against the walls of the excavation, the walls have a trapezoid-like cross-section which, after casting with cement significantly strengthens the load bearing element 89, as illustrated in FIG. 18.

Whilst in the embodiments specifically described above, the excavating equipment has always been employed in effecting substantially vertical excavations, the invention is equally applicable for use in substantially horizontal excavation such as for example, tunneling. Here, however, additional power coupling must be provided for excavating equipment seeing that in this case gravity is not effective in assisting the actual excavation.

I claim:

1. Excavating equipment comprising a rigid support structure; surface clamping means articulately mounted on said support structure; excavating means downstream of said surface clamping means in a direction of excavation; said surface clamping means being substantially as wide as said excavating means; urging means for urging the excavation means in the direction of excavation and during excavating; said urging means being connected at one end thereof to the support structure and at an opposed end thereof to said excavating means, power means coupled to said excavating means for operating same and for operating said urging means, said power means being also coupled to said surface clamping means for laterally displacing said clamping means against rigid supporting surfaces so as to consolidate the surfaces to generate a counter-reaction to forces generated by operation of said excavating means; and equipment displacing means coupled to said support structure for displacing said equipment into and out of an excavation.

2. Excavating equipment according to claim 1, wherein said urging means is connected at one end thereof to the support structure and at an opposed end thereof to said excavation means.

3. Excavating equipment according to claim 1, wherein said excavating means comprises a pair of clamshell buckets reciprocally pivotable about substantially parallel pivotal axes towards and away from each other under the influence of said power means.

4. Excavating equipment according to claim 3, wherein said clamshell buckets are pivotally linked at a bottom end of the urging means.

5. Excavating equipment according to claim 3, wherein said surface clamping means comprises a pair of substantially planar pressure plates located substantially normally to said pivotal axes.

6. Excavating equipment, according to claim 5, wherein there is furthermore provided a second pair of substantially planar pressure plates located substantially parallel to said pivotal axes.

7. Excavating equipment according to claim 5, wherein said power means comprises a first set of hydraulically operated pistons displaceable within cylinders rigidly mounted on said support structure and articulated to said pressure plates.

8. Excavating equipment according to claim 5, wherein said pressure plates are spring biased towards each other.

9. Excavating equipment according to claim 5, wherein said power means comprises a pair of pneumatic inflatable air cushions respectively biased against said pressure plates.

10. Excavating equipment according to claim 7, wherein said power means furthermore comprises a second set of hydraulically operated pistons displaceable within cylinders rigidly mounted on said support structure and articulated to said excavating means.

11. Excavating equipment according to claim 10, wherein said second hydraulically operated pistons are disposed at an angle with respect to a vertical axis of the equipment.

12. Excavating equipment according to claim 10, wherein said power means furthermore comprises a third set of hydraulically operated pistons displaceable within essentially vertical cylinders rigidly mounted on said support structure and articulated to said excavating means.

13. Excavating equipment comprising a rigid support structure; surface clamping means articulately mounted on said rigid support structure; excavating means downstream of said surface clamping means in a direction of excavation; said surface clamping means being substantially as wide as the excavating means; means for urging the excavating means in the direction of excavation and during excavating; power means coupled to said excavating means for operating same and for operating said urging means, said power means being also coupled to said surface clamping means for laterally displacing said clamping means against rigid supporting surfaces so as to generate a counter-reaction to forces generated by operation of said excavating means; and equipment displacing means coupled to said support structure for displacing said equipment into and out of an excavation, wherein said rigid support structure comprises a mobile displaceable boxlike frame and wherein said equipment displacing means comprises a hoisting cable coupled at one end to said equipment and passing over a pulley arrangement mounted on said boxlike frame, said equipment being suspended adjacent an end wall of said boxlike frame.

14. Excavating equipment according to claim 12, wherein there is furthermore mounted on said end wall a pair of extendable reaction members coupled to said excavating means the arrangement being such that operative displacement of said excavating means is accompanied by a counter-reactive force created by resistance to displacement of said extendable reaction members.

15. Excavating equipment comprising a first rigid support structure; surface clamping means articulately mounted on said first structure; power means coupled to said surface clamping means for displacing said surface clamping means against supporting surfaces, a second rigid support structure articulated to said first structure; expansion means for displacing said second rigid structure with respect to said first rigid structure; rotary milling cutters having a diameter mounted on said second rigid structure; means for urging said second rigid structure in a direction of excavating during excavating; said surface clamping means being substantially as wide as the diameter of said milling cutters; power means coupled to said pair of rotary milling cutters for operating same, forces generated during operation of said excavating equipment being countered by a counter-reaction generated by displacement of said surface clamping means against said supporting surfaces.

16. Excavating equipment comprising a rigid support structure; surface clamping means articulately mounted on said rigid support structure; excavating means downstream of said surface clamping means in a direction of excavation; said surface clamping means being substantially as wide as the excavating means; means for urging the excavation means in a direction of excavation and during excavating; power means coupled to said excavating means for operating same and for operating said urging means, said power means being also coupled to said surface clamping means for laterally displacing said surface clamping means against rigid supporting surfaces so as to generate a counter-reaction to forces generated by operation of said excavating means; and equipment displacing means coupled to said rigid support structure for displacing said equipment into and out of an excavation, wherein said surface clamping means includes pressure plates respectively provided with successive, axially displaced hydraulically operated pistons of differing strokes so as to impart to each pressure plate an inclination which is correspondingly imparted to the impacted walls.

17. Excavating equipment comprising a rigid support structure; surface clamping means articulately mounted on said rigid support structure; excavating means downstream of said surface clamping means in a direction of excavation; said surface clamping means being substantially as wide as the excavating means; urging means for urging the excavation means in direction of excavating and during excavating; power means coupled to said excavating means for operating same and for operating said urging means, said power means being also coupled to said surface clamping means for laterally displacing said surface clamping means against rigid supporting surfaces so as to generate a counter-reaction to forces generated by operation of said excavating means; and equipment displacing means coupled to said support structure for displacing said equipment into and out of an excavation, wherein said surface clamping means includes pressure plates releasably attached to an open ended molding container adapted to be pressed into excavated walls so as to provide for a subsequent casting of a ledge.

* * * * *